United States Patent [19]

Johansson

[11] 4,290,210

[45] Sep. 22, 1981

[54] DEVICE FOR DRYING WEB MATERIAL

[75] Inventor: Eric G. B. Johansson, Växjö, Sweden

[73] Assignee: AB Svenska Flaktfabriken, Nacka, Sweden

[21] Appl. No.: 97,917

[22] Filed: Nov. 28, 1979

[30] Foreign Application Priority Data

Dec. 6, 1978 [SE] Sweden ..... 7812565

[51] Int. Cl.[3] ..... F26B 13/20

[52] U.S. Cl. ..... 34/156; 34/160; 226/97; 239/DIG. 7

[58] Field of Search ..... 226/97, 196, 199; 34/155, 160, 156; 239/DIG. 7

[56] References Cited

U.S. PATENT DOCUMENTS

| | | | |
|---|---|---|---|
| 3,231,165 | 1/1966 | Wallin et al. | 226/97 |
| 3,957,187 | 5/1976 | Puigrodon | 34/156 |
| 3,982,327 | 9/1976 | Kurie et al. | 34/156 |
| 3,982,328 | 9/1976 | Gustafsson et al. | 34/160 |
| 4,058,244 | 11/1977 | Vits | 34/156 |
| 4,074,841 | 2/1978 | Kramer et al. | 34/156 |
| 4,137,644 | 2/1979 | Karlsson | 34/23 |

*Primary Examiner*—Larry I. Schwartz

*Attorney, Agent, or Firm*—Dann, Dorfman, Herrell & Skillman

[57] ABSTRACT

A device for drying a web, such as paper web. Air distribution boxes 4 are arranged on both sides of the plane 2 of a path of guidance for the web. Each one of the distribution boxes includes a line of first opening means 6 extending transversally to the direction of guidance and arranged to direct the air essentially perpendicularly towards said plane, and a line of opening means 8 essentially parallel to the line of first opening means and arranged to direct the fluid essentially along said plane. Guide means 22 direct the air issued from opening means 8 away from the line of first opening means 6 towards and along an adjoining surface portion 10 of the box on a higher level than the line of first opening means 6. Each line of the first opening means in the box on either side of said plane is located in front of said surface portion 10 of the confronting box located on other side of the plane.

13 Claims, 13 Drawing Figures

Figures 1A, 1B:
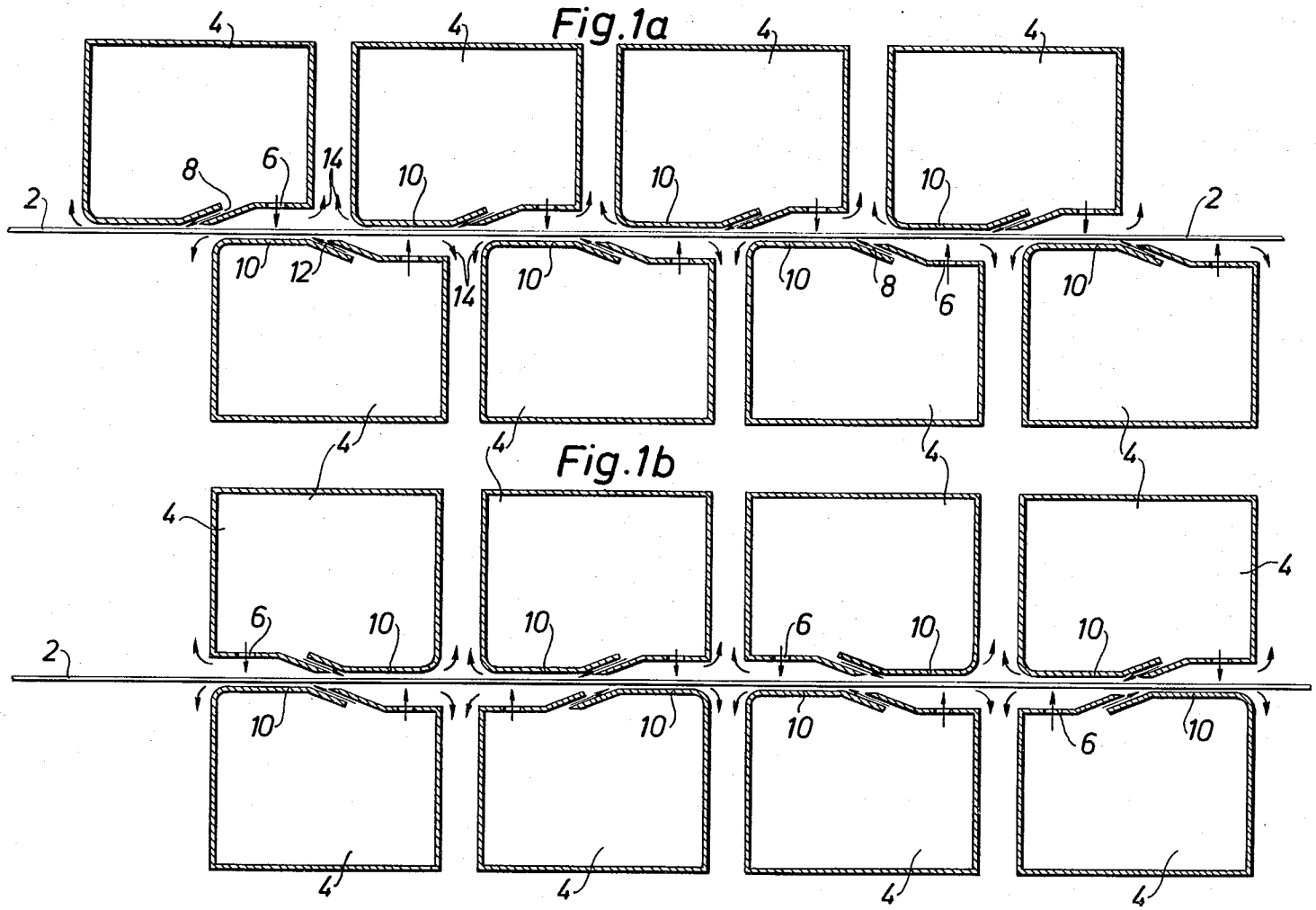

2
4
6
8
10
12
14

DEVICE FOR DRYING WEB MATERIAL

The present invention relates to a device for drying a web, in which gas distribution boxes are arranged on both sides of the plane of a path of a guidance for the web, said boxes including first opening means arranged to direct the gas essentially perpendicularly towards said plane and second opening means arranged to direct the gas essentially along said plane.

In the U.S. Pat. No. 3,982,328 a device for drying a web is described. On each side of a conveyance path for the web a line of distribution boxes for directing air to the web are arranged. Each line includes alternately boxes for blowing air essentially perpendicularly to the web and boxes for blowing air tangentially with respect to the web for supporting and stabilizing it. The last-mentioned boxes more specifically function according to the principal that appears from the U.S. Pat. No. 3,231,165. In short each box has two parallel lines of openings directing the air in opposite directions along the web. This causes a force that pulls the web towards the surface of the box until the distance becomes so small that the static pressure drop equalizes said force. In the device according to the U.S. Pat. No. 3,982,328 each box for perpendicular blowing against the web is furthermore always arranged opposite to and confronts a box for tangential blowing on the opposite side of the web.

The drying device according to the U.S. Pat. No. 3,982,328 has the disadvantage of the comparably expensive and complicated construction since it requires two different kinds of air distribution boxes, which furthermore require an accurate adjustment relatively to each other and the web in order to obtain a web guidance as stable as possible.

A further disadvantage of this device is that there are certain difficulties to stabilize the floating distance between the web and the boxes. These difficulties are mainly due to the fact that in the boxes for tangential blowing there is a tendency to forming a low pressure in the area between the two lines of openings. This problem is also discussed in the U.S. Pat. No. 4,137,644 and has, according to the invention stated herein, obtained the solution that the boxes for tangential blowing are divided into two parallel sub boxes, one for each blowing direction, there being supplied between said sub boxes a great volume of air with essentially the same static pressure as that prevailing on the upper side of the web. In the U.S. Pat. No. 4,137,644 it is particularly recommended that the stated solution can be applied to a drying patent according to the U.S. Pat. No. 3,982,328. Although this suggestion implies that a more stable web guidance is obtained it involves a certain further cost increase of drying plant in its entirety due to the more complicated design of the boxes for tangential air supply.

One object of the present invention is to lessen the costs and make more simple the construction of drying plants of the kind here in question, while securing a stable web guidance and a great drying action.

This object has been attained in the device according to the invention in that said opening means of each of the distribution boxes include a line of said first opening means extending transverses transversally to said path of guidance and a line of said second opening means essentially parallel thereto, guide means being associated with said second opening means for directing the gas issuing therefrom away from the line of said first opening means towards and along an adjoining surface portion of the box on a higher level than said first opening means, said first opening means of each box on one side of said path being located in front of said surface portions on a higher level in a confronting box on the other side of said path.

Figure 2:
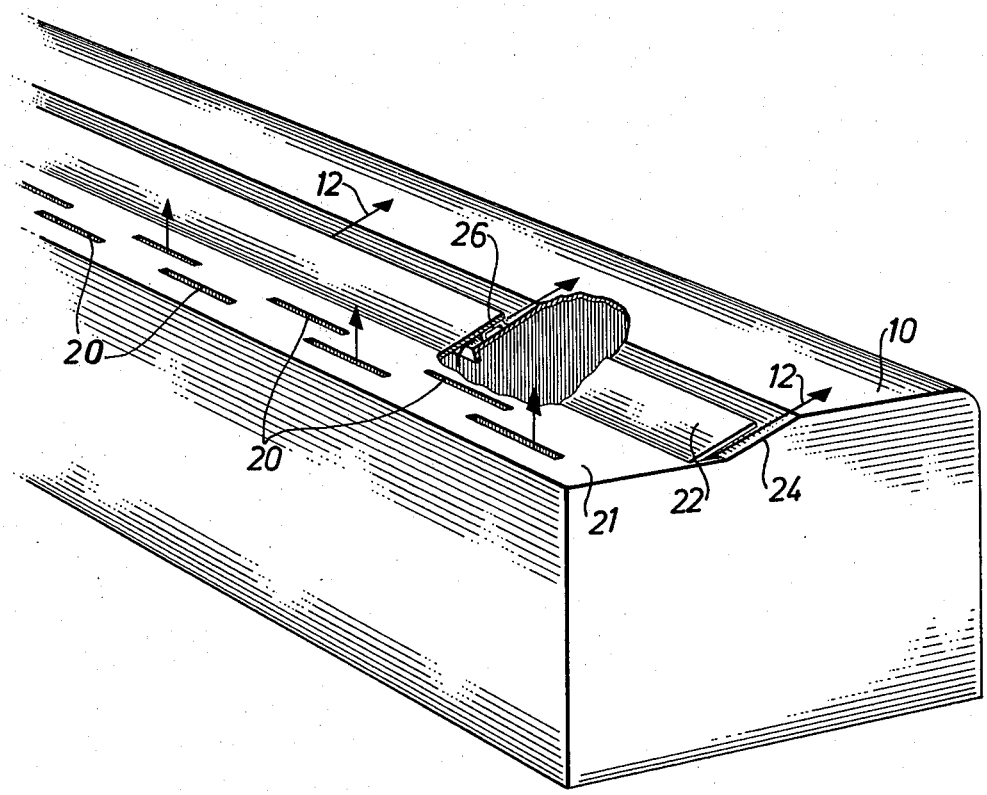

Besides the advantages discussed above, the invention makes possible the realization of a module system, that permits construction of mutually partly somewhat different systems adapted to different purposes. This as well as other advantages will appear from the description below of some embodiments On the drawings illustrate FIGS. 1*a* and *b* schematically a side view, partly in section, of each a drying plant according to the invention;

FIG. 2 a perspective view of an embodiment of an air distribution box intended to be used at plants of the kind shown in FIGS. 1A and 1B;

FIGS. 3*a–f* in section different alternative embodiments of one portion of the distribution box illustrated in FIG. 2; and FIGS. 4*a–d* different alternative embodiments of another portion of a distribution box of the kind shown in FIG. 2.

In the different drawing figures the same reference characters are used to designate the same or like acting details of the illustrated embodiments.

In FIG. 1*a* a web 2 is moving in its length direction along the plane of a conveyance path. On both sides of said plane a number of mutually similar air distribution boxes 4 are arranged on line after each other in the moving direction of the web. Perpendicularly to the plane of the drawing the distribution boxes 4 have an extension approximately corresponding to the width of the web 2.

Each box 4 has a line of first opening means 6 extending transversally to the moving direction of the web 2. In parallel with said line the box 4 has a line of second opening means 8, in the embodiment shown having the form of a continuous slit. The opening means 6 are arranged to direct the air essentially straight towards said plane of the path of conveyance, whereas the opening means 8 are arranged to direct the air essentially along said plane.

More specifically, according to the invention, the opening means 6 of each distribution box 4 on either side of said plane are located in front of a surface portion of the distribution box 4 on the other side of said path, towards which a line of said second opening means 8 of the last-mentioned boxes are arranged to direct the air. Thus, at the outermost left box 4 in FIG. 1 the first opening means 6 are arranged in front of a portion 10 of an air distribution box 4 of the opposite side, towards which portin 10 said second opening means 8 of the last-mentioned box are arranged to direct the air flow according to the arrow 12. The air flows through the opening means 6 and 8 are conducted away between the distribution boxes according to the arrows 14.

In the plant according to FIG. 1*a* the air flows coming from the opening means 8 and sweeping along the surface portion 10 of the distribution boxes, besides a certain drying action have mainly a stabilizing and supporting action on the web 2. This action, being based on hydrodynamic principles is of the same kind as is described in the U.S. Pat. No. 3,231,165. Shortly, it is thus based on the fact that a flow between two surfaces (in FIG. 1 between the surface 10 and the web of material 2) gives rise to a force, that pulls the surfaces towards each other until the distance between them becomes so small that the static pressure drop for the flow equalizes said force. The air through the opening means 6, being directed straight towards the web 2, is used to dry the web of material. The latter can for example be a paper web both surfaces of which shall be dried after application of a surface impregnating means thereon.

By the illustrated geometrical arrangement with the surface portion of the distribution boxes 4 containing the opening means 6 at a greater distance from the web than the portion 10 an advantageous distribution of the drying air is obtained, said drying air at the same time further contributing to stabilizing the web 2, whereby a very stable web guidance without flatter is obtained.

The distance between the distribution boxes and the web is chosen so that a maximum of heat transfer by means of the drying air is obtained at a certain determined size and geometrical shape of the opening means 6.

In the embodiment shown in FIG. 1*a* all openings means 8 are arranged to conduct the air flow in the same direction. The web 2 can then be driven in the opposite direction by drive rolls not shown, whereby, in a manner known per se, a further drying action of the web is obtained. Driving the web 2 in the same direction as that of the air flows from the opening means 8 is, however, also possible. According to a very advantageous embodiment this is obtained by means of said flows, so that thus drive rolls become unnecessary.

In the embodiment according to FIG. 1*b* the opening means 8 are alternately oppositely directed on both sides of the web. In order to ensure that the opening means 6 will be located opposite to portions of the distribution boxes of the opposite side, which are swept over by air from the corresponding opening means 8, a mutual shift of the distribution boxes of both sides has been done relative to embodiment according to FIG. 1*a*. In the embodiment of FIG. 1*b* the web 2 is driven in either direction by drive rolls not shown.

In the above described two embodiments only principally important details have been described and shown on the drawing. Other details such as frameworks, blower devices, return tubes, air filters, air heating devices, and drive arrangements for the web of material etcetera, have been cancelled since they are well known to the expert, e.g. from existing paper dryers.

In FIG. 2 one of the air distribution boxes 4 is shown more in detail. The first opening means 6 are here made in the form of two broken slit lines 20 in a surface portion 21. The second opening means 8 are made in the form of a continuous slit between a guide plate 22 and a central portion 24 of the air distribution box parallel therewith. The last-mentioned central portion 24 forms a transition between the surface portion 21 containing the slit lines 20 and the surface portion 10. At 26 one of a plurality of spacer elements between the guide plate 22 and the surface portion 24 is indicated.

In FIGS. 3*a–f* some different alternative embodiments of the opening means 8 are shown.

Figure 3A:
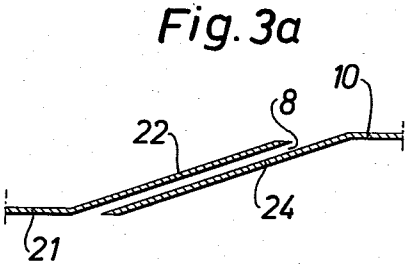
Figure 3B:
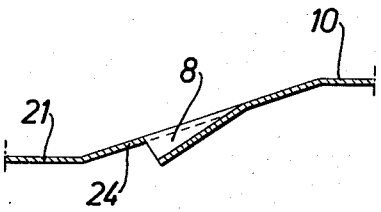
Figure 3C:
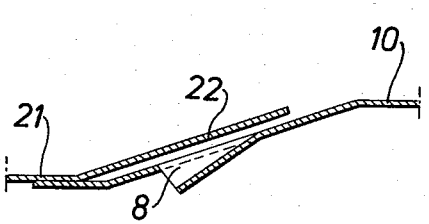
Figure 3D:
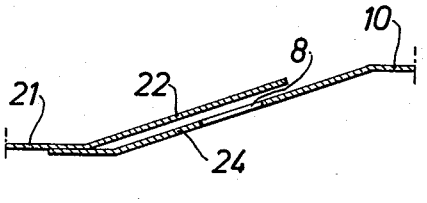
Figure 3E:
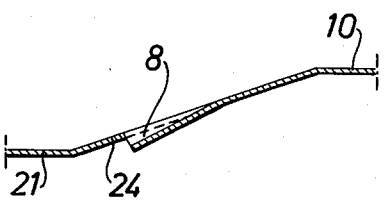
Figure 3F:
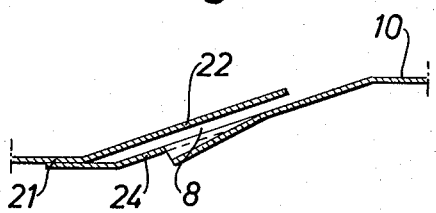

FIG. 3*a* corresponds to the embodiment according to FIG. 2 i.e. a slit is arranged between the surface portion 24 and the guide plate 22. FIG. 3*b* represents the case that a line of eyelid openings of the same type as described in the U.S. Pat. No. 3,231,165 is arranged in the transition surface portion 24. In FIG. 3*c* a guide plate 22 has been located over the eyelid openings according to FIG. 3*b*. FIG. 3*d* illustrates the case that the opening means 8 consist of a number of round holes in the surface portion 24 under a guide plate 22. FIG. 3*e* illustrates a case, where a line of longitudinal slits have been punched in the surface portion 24. In FIG. 3*f* finally a guide plate 22 has been located over the slit line according to FIG. 3*e*.

FIGS. 4*a–d* in a plan view illustrate different embodiments of the opening means 6.

Figure 4D:
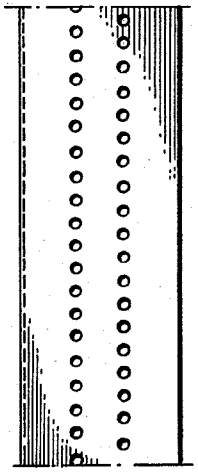
Figure 4C:
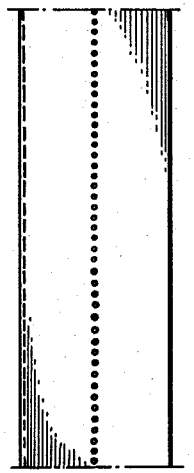
Figure 4B:
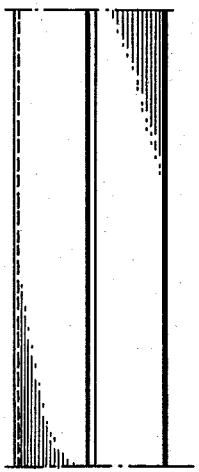
Figure 4A:
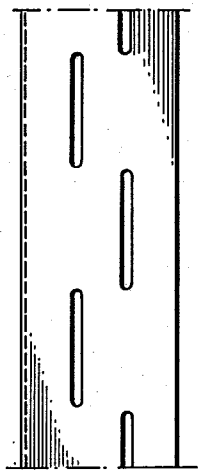

The embodiment according to FIG. 4*a* corresponds to the embodiment according to FIG. 2, i.e. one has two lines of slits 20. In FIG. 4*b* the opening means 6 are in the form of a continuous slit, in FIG. 4*c* in the form of a line of small round holes with a small pitch for obtaining slit action, and in FIG. 4*d* in the form of two lines of bigger round holes.

I claim:

1. A device for drying a web (2) having guidance means for guiding the web in a plane, gas distribution boxes (4) arranged on both sides of the plane of guidance for the web, said boxes (4) including first opening means (6) arranged to direct the gas essentially perpendicularly towards said plane and second opening means (8) arranged to direct the gas essentially along said plane, characterized in that in each of the distribution boxes said first opening means (6) are disposed in a first line extending transverse to said path of guidance and said second opening means (8) are disposed in a second line essentially parallel thereto, said box having an adjoining surface portion (10) extending alongside said second line at a side remote from said first line, guide means (22) associated with said second opening means for directing the gas issuing therefrom away from the first line towards and along said adjoining surface portion (10) of the box, said surface portion being on a higher level than said first opening means (6), said first opening means (6) of each box on one side of said guidance plane being located directly opposite said surface portions (10) on a higher level in a confronting box on the other side of said guidance plane.

2. A device according to claim 1, characterized in that in the boxes on each side of said plane (2) said second and first opening means (6,8), respectively alternate in the direction of guidance.

3. A device according to claim 1, characterized in that in the boxes on each side of said plane (2) the lines of said first and second openings are arranged in pairs, with the pairs of first opening means (6) alternating with pairs of second opening means (8).

4. A device according to claim 1, characterized in that the line of said second opening means (8) is located in an inclined transition (24) between said surface portion (10) and said first opening means.

5. A device according to claim 4, characterized by a guide surface (22) parallel to and extending near the inclined transition (24) and overlying said second opening means (8) to constitute said guide means.

6. A device according to claim 1, characterized in that the guide means of said second opening means (8) of the distribution boxes (4) are arranged to direct the gas flows in the same direction.

7. A device according to claim 6, characterized in that the guide means of said second opening means (8) are arranged to direct the gas flows so that they serve as drive means for the web.

8. A device for drying a web (2) having guidance means for guiding the web in a plane, gas distribution boxes (4) arranged on both sides of the plane of guidance for the web, said boxes (4) including a wall structure confronting the plane of guidance having first opening means (6) arranged to direct the gas essentially perpendicularly towards said plane, and second opening means (8) arranged to direct the gas essentially along said plane, in each of the distribution boxes said first opening means (6) being disposed in a first portion of said wall structure in a line extending transverse to said path of guidance, and said second opening means (8) being disposed in a second portion of said wall structure in a line essentially parallel to said first line, said wall structure having an adjoining third surface portion (10) extending alongside said second portion at a side remote from said first portion, guide means (22) associated with said second opening means for directing the gas issuing therefrom away from the first portion towards and along said adjoining third surface portion (10) of the box, said third surface portion being on a higher level than said first portion (6), characterized in that said first opening means (6) of each box on one side of said guidance plane are located directly opposite said third surface portions (10) on a higher level in a confronting box on the other side of said guidance plane, and said device includes means for discharging the gas flows directed from said opening means away from said guidance plane on each side of said wall structures.

9. A device according to claim 8 wherein said first and third wall portions are in planes parallel to said guidance plane, and said second wall portion is located in an inclined transition between said first and third wall portions.

10. A device according to claim 8 wherein said distribution boxes are arranged in spaced series above and below said guidance plane, the spacing between said boxes comprising the means for discharging the gas flows.

11. A device according to claim 8 wherein said second portion of said box on one side of the guidance plane is directly opposite said means for discharging the gas flows from the boxes on the other side of the guidance plane.

12. A device according to claim 8 wherein said second portion of each box on one side of the guidance plane is directly opposite said second portion of a box on the other side of the guidance plane, said guide means (22) of said boxes respectively directing the gas issuing from the second opening means in counter directions.

13. A device according to claim 8 wherein said third surface portion is imperforate to provide a stabilizing and supporting action on the web by the gas directed between the said third surface portion and the web from the second opening means.

* * * * *

UNITED STATES PATENT AND TRADEMARK OFFICE

CERTIFICATE OF CORRECTION

PATENT NO. : 4,290,210
DATED : September 22, 1981
INVENTOR(S) : Eric G. B. Johansson It is certified that error appears in the above-identified patent and that said Letters Patent are hereby corrected as shown below:

Column 1, line 52 delete "patent" and insert --plant--;
line 65 delete "transverses transversally" and insert --transverse--;
Column 2, line 56 delete "portin" and insert --portion--.

Signed and Sealed this

*First* Day of *December 1981*

[SEAL]

*Attest:*

GERALD J. MOSSINGHOFF

*Attesting Officer*

*Commissioner of Patents and Trademarks*